US007442480B2

(12) United States Patent
Kanamaru et al.

(10) Patent No.: US 7,442,480 B2
(45) Date of Patent: Oct. 28, 2008

(54) POSITIVELY CHARGEABLE TONER

(75) Inventors: Yutaka Kanamaru, Wakayama (JP); Masahito Yamazaki, Wakayama (JP); Jiro Takemoto, Wakayama (JP)

(73) Assignee: KAO Corporation, Tokyo (JP)

( * ) Notice: Subject to any disclaimer, the term of this patent is extended or adjusted under 35 U.S.C. 154(b) by 0 days.

(21) Appl. No.: 10/419,910

(22) Filed: Apr. 22, 2003

(65) Prior Publication Data

US 2003/0203302 A1 Oct. 30, 2003

(30) Foreign Application Priority Data

Apr. 22, 2002 (JP) ..... 2002-119249

(51) Int. Cl.
*G03G 9/087* (2006.01)
*G03G 9/09* (2006.01)

(52) U.S. Cl. ..... 430/108.21; 430/108.2; 430/108.4; 430/109.3; 430/109.4

(58) Field of Classification Search ..... 430/108.2, 430/108.24, 108.3, 108.4, 108.5, 109.3, 109.4, 430/108.21, 108.23
See application file for complete search history.

(56) References Cited

U.S. PATENT DOCUMENTS

| | | | | | |
|---|---|---|---|---|---|
| 3,888,667 | A | * | 6/1975 | Lee | 430/64 |
| 4,035,310 | A | * | 7/1977 | Mammino et al. | 430/108.23 |
| 4,386,147 | A | * | 5/1983 | Seimiya et al. | 430/99 |
| 4,845,004 | A | * | 7/1989 | Kobayashi | 430/108.24 |
| 4,960,669 | A | * | 10/1990 | Mori et al. | 430/137.17 |
| 5,045,865 | A | * | 9/1991 | Crystal et al. | 347/114 |
| 5,378,571 | A | * | 1/1995 | Macholdt et al. | 430/108.2 |
| 5,472,819 | A | * | 12/1995 | Hayashi et al. | 430/108.2 |
| 6,080,519 | A | * | 6/2000 | Ishiyama et al. | 430/110.3 |
| 6,087,058 | A | * | 7/2000 | Semura et al. | 430/109.4 |
| 6,156,473 | A | * | 12/2000 | Tyagi et al. | 430/137.19 |
| 6,171,743 | B1 | * | 1/2001 | Nakamura | 430/110.3 |
| 6,534,229 | B2 | * | 3/2003 | Ohba et al. | 430/108.2 |
| 2001/0018157 | A1 | * | 8/2001 | Aoki et al. | 430/109.4 |
| 2001/0026899 | A1 | * | 10/2001 | Uchida et al. | 430/108.4 |

FOREIGN PATENT DOCUMENTS

| | | | | |
|---|---|---|---|---|
| JP | 44-6398 | | | 3/1969 |
| JP | 61282850 | A | | 12/1986 |
| JP | 2135369 | A | | 5/1990 |
| JP | 04-57064 | | * | 2/1992 |
| JP | 4084142 | A | | 3/1992 |
| JP | 4-158370 | A | | 6/1992 |
| JP | 05-072802 | | * | 3/1993 |
| JP | 6501566 | A | | 2/1994 |
| JP | 06-059498 | | * | 3/1994 |
| JP | 06-118721 | | * | 4/1994 |
| JP | 10104876 | A | | 4/1998 |
| JP | 2000-162812 | A | | 6/2000 |
| JP | 2001-305799 | A | | 11/2001 |

OTHER PUBLICATIONS

Japanese Patent Office Machine-Assisted Translation of JP 05-072802 (Pub Mar. 1993).*
Japanese Patent Office Machine-Assisted Translation of JP 06-059498 (Pub Mar. 1994).*
USPTO English-languge translation of JP 04-57064 (pub. Feb. 1992).*
Thomson machine-assisted translation of JP 06-59498 A (pub. Mar. 1994).*
Thomson machine-assisted translation of JP 05-72802 A (pub. Mar. 1993).*
American Chemical Society File Registry No. 980-26-7 on STN, copyright 2005.*
Japanese Patent Office machine-assisted translation of JP 06-118721 (pub. Apr. 1994).*
Diamond, A.S. , ed., *Handbook of Imaging Materials*, Marcel Dekker, Inc., NY (1991), p. 169.*
American Chemical Society (ACS) File Registry No. RN 147-14-8 on STN, entered in STN on Nov. 16, 1984, copyright 2006.*
American Chemical Society (ACS) File Registry No. RN 509-34-2 on STN, entered in STN on Nov. 16, 1984, copyright 2006.*
American Chemical Society (ACS) File Registry No. RN 6358-85-6 on STN, entered in STN on Nov. 16, 1984, copyright 2006.*
American Chemical Society (ACS) File Registry No. RN 76199-85-4 on STN, entered in STN on Nov. 16, 1984, copyright 2007.*
American Chemical Society (ACS) File Registry No. RN 574-93-6 on STN, entered in STN on Nov. 16, 1984, copyright 2007.*
American Chemical Society (ACS) File Registry No. RN 980-26-7 on STN, entered in STN on Nov. 16, 1984, copyright 2007.*
American Chemical Society (ACS) File Registry No. RN 1047-16-1 on STN, entered in STN on Nov. 16, 1984, copyright 2007.*

* cited by examiner

*Primary Examiner*—Janis L Dote
(74) *Attorney, Agent, or Firm*—Birch, Stewart, Kolasch & Birch, LLP

(57) ABSTRACT

A positively chargeable toner comprising a resin binder, a specified compound represented by the formula (I), and a higher fatty acid with a long-chain alkyl group having 8 to 22 carbon atoms and/or a metal salt thereof. The positively chargeable toner is a positively chargeable toner used for the development of a latent image formed in electrophotography, electrostatic recording method, electrostatic printing method or the like.

13 Claims, No Drawings

POSITIVELY CHARGEABLE TONER

BACKGROUND OF THE INVENTION

1. Field of the Invention

The present invention relates to a positively chargeable toner used for the development of a latent image formed in electrophotography, electrostatic recording method, electrostatic printing method or the like.

2. Discussion of the Related Art

As the positively chargeable charge control agents for toner, Nigrosine dyes, quaternary ammonium salt compounds and the like have been disclosed. However, the Nigrosine dyes having a black color cannot be used for color toners, so that the use of the dyes is limited.

On the other hand, there have been known various quaternary ammonium salt compounds which can also be used for color toners (Japanese Patent Laid-Open No. 2001-305799, and the like). However, when the quaternary ammonium salt compound is used alone, satisfactory properties cannot be obtained, so that it is necessary to use the compound in combination with another charge control agent. Therefore, a further improvement in positively chargeable charge control agents has been desired.

An object of the present invention is provide a positively chargeable toner which comprises a positively chargeable charge control agent which does not adversely affect the color of a color toner, and which is excellent in the triboelectric stability.

These and other objects of the present invention will be apparent from the following description.

SUMMARY OF THE INVENTION

The present invention relates to a positively chargeable toner comprising:

a resin binder, a compound represented by the formula (I):

(I)

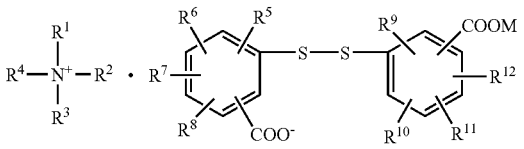

wherein each of $R^1$ to $R^4$, which may be identical or different, is hydrogen atom, an alkyl group having 1 to 30 carbon atoms, an alkenyl group having 2 to 30 carbon atoms, an aryl group having 6 to 20 carbon atoms or an aralkyl group having 7 to 20 carbon atoms; each of $R^5$ to $R^{12}$, which may be identical or different, is hydrogen atom, an alkyl group having 1 to 30 carbon atoms or an alkenyl group having 2 to 30 carbon atoms; and M is hydrogen atom or a monovalent metal ion, and a higher fatty acid with a long-chain alkyl group having 8 to 22 carbon atoms and/or a metal salt thereof.

DETAILED DESCRIPTION OF THE INVENTION

The toner of the present invention comprises at least a resin binder, the compound represented by the formula (I) described below, and a higher fatty acid with a long-chain alkyl group having 8 to 22 carbon atoms and/or a metal salt thereof.

The resin binder in the present invention includes polyesters, vinyl resins such as styrene-acrylic resins, epoxy resins, polycarbonates, polyurethanes, hybrid resin in which two or more resin components are partially chemically bonded to each other, and the like. Among them, the polyesters, and/or the hybrid resins in which a polyester component and a vinyl resin component are partially chemically bonded to each other, are preferable. The content of the polyester or the hybrid resin, or the total content of both in the case where the two resins are used together, is preferably from 50 to 100% by weight, more preferably from 80 to 100% by weight, especially preferably 100% by weight, of the resin binder.

The polyester is prepared by polycondensation of an alcohol component comprising a dihydric or higher polyhydric alcohol, and a carboxylic acid component comprising a dicarboxylic or higher polycarboxylic acid compound.

The dihydric alcohol includes alkylene(2 or 3 carbon atoms) oxide(average number of moles: 1 to 10) adducts of bisphenol A such as polyoxypropylene(2.2)-2,2-bis(4-hydroxyphenyl)propane and polyoxyethylene(2.2)-2,2-bis(4-hydroxyphenyl)propane, ethylene glycol, propylene glycol, 1,6-hexanediol, bisphenol A, hydrogenated bisphenol A, and the like.

The trihydric or higher polyhydric alcohol includes sorbitol, 1,4-sorbitan, pentaerythritol, glycerol, trimethylolpropane, and the like.

In addition, the dicarboxylic acid compound includes dicarboxylic acids such as phthalic acid, isophthalic acid, terephthalic acid, fumaric acid, and maleic acid; a substituted succinic acid of which substituent is an alkyl group or alkenyl group having 1 to 20 carbon atoms; acid anhydrides and alkyl(1 to 12 carbon atoms) esters of these acids; and the like.

The tricarboxylic or higher polycarboxylic acid compound includes 1,2,4-benzenetricarboxylic acid (trimellitic acid), acid anhydrides thereof, alkyl(1 to 12 carbon atoms) esters thereof, and the like.

The polyester can be prepared by, for instance, polycondensation of the alcohol component and the carboxylic acid compound at a temperature of 180° to 250° C. in an inert gas atmosphere in the presence of an esterification catalyst as desired.

In the present invention, the hybrid resin may be obtained by using two or more resins as raw materials, or it may be obtained by using one resin and raw material monomers of the other resin. Further, the hybrid resin may be obtained from a mixture of raw material monomers of two or more resins. In order to efficiently obtain a hybrid resin, those obtained from a mixture of raw material monomers of two or more resins are preferable.

Therefore, it is preferable that the hybrid resin is obtained by mixing raw material monomers of two polymerization resins each having independent reaction paths, preferably raw material monomers for a polyester and raw material monomers for an addition polymerization resin such as a vinyl resin, and concurrently carrying out a condensation polymerization reaction and an addition polymerization reaction in the same reaction vessel. Concretely, the hybrid resin disclosed in Japanese Patent Laid-Open No. Hei 10-087839 (U.S. Pat. No. 5,908,727) is preferred.

The polyester and the hybrid resin have a softening point of preferably from 80° to 165° C., and a glass transition point of preferably from 50° to 85° C.

In addition, it is preferable that the polyester and the hybrid resin have an acid value of from 0.5 to 60 mg KOH/g, from the viewpoints of the dispersibility of a colorant and the transferability, and that the polyester and the hybrid resin have a hydroxyl value of from 1 to 60 mg KOH/g.

In the present invention, the compound represented by the formula (I):

(I)

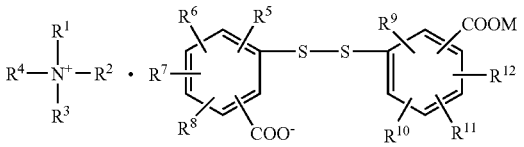

wherein each of $R^1$ to $R^4$, which may be identical or different, is hydrogen atom, an alkyl group having 1 to 30 carbon atoms, an alkenyl group having 2 to 30 carbon atoms, an aryl group having 6 to 20 carbon atoms or an aralkyl group having 7 to 20 carbon atoms; each of $R^5$ to $R^{12}$, which may be identical or different, is hydrogen atom, an alkyl group having 1 to 30 carbon atoms or an alkenyl group having 2 to 30 carbon atoms; and M is hydrogen atom or a monovalent metal ion, exhibits its function as a positively chargeable charge control agent.

In the formula (I), the alkyl group and the alkenyl group may be any of linear, branched or cyclic.

In the formula (I), each of $R^1$ to $R^4$ is preferably an alkyl group having 1 to 30 carbon atoms, more preferably an alkyl group having 1 to 8 carbon atoms.

Each of $R^5$ to $R^{12}$ is preferably hydrogen atom or an alkyl group having 1 to 30 carbon atoms, more preferably hydrogen atom.

The monovalent metal ion represented by M includes lithium, sodium, potassium and the like, and M is preferably hydrogen atom.

The content of the compound represented by the formula (I) is preferably from 0.1 to 10 parts by weight, more preferably from 0.1 to 3 parts by weight, based on 100 parts by weight of the resin binder.

The higher fatty acid and the metal salt thereof in the present invention remarkably improves the function of the compound represented by the formula (I) as positively chargeable charge control agent. The higher fatty acid having a long-chain alkyl group having 8 to 22 carbon atoms includes single fatty acids, palm oil-based fatty acids, beef tallow-based fatty acids, and the like. Among them, the single fatty acids are preferable. The single fatty acids include, in the order of smaller molecular weight, caprylic acid, capric acid, undecyl acid, lauric acid, tridecyl acid, myristic acid, palmitic acid, stearic acid, behenic acid, lignoceric acid, cerotic acid, montanic acid, oleic acid, elaidic acid, linoleic acid, linolenic acid, erucic acid, ricinoleic acid, dihydroxystearic acid, cyclic fatty acid, dibasic acids, and the like. A higher fatty acid with a long-chain alkyl group having 18 to 22 carbon atoms is preferable, and stearic acid is more preferable.

In addition, the metal for the metal salt of the higher fatty acid includes zinc, lead, iron, copper, tin, cadmium, aluminum, calcium, magnesium, nickel, cobalt, manganese, lithium, barium and the like. Preferred metal salts of the higher fatty acids in the present invention include zinc laurate, zinc stearate, aluminum stearate, calcium stearate, magnesium stearate and lithium stearate.

In the present invention, each of the higher fatty acid and the metal salt of the higher fatty acid may be used alone or in admixture thereof. The metal salts of the higher fatty acids are preferable from the viewpoint of the triboelectric stability in a high-humidity environment, and metal salts of stearic acid are more preferable.

The content of the higher fatty acid or the metal salt of the higher fatty acid, or the total content of both in the case where the fatty acid and the metal salt are used together, is preferably from 0.1 to 10 parts by weight, more preferably from 0.5 to 3 parts by weight, based on 100 parts by weight of the resin binder.

The function of the compound represented by the formula (I) functions as a positively chargeable charge control agent has conventionally been recognized. However, the triboelectric charges are lowered by a continuous printing when the compound is used alone. In contrast, in the present invention, there is exhibited a totally unexpected effect that the triboelectric stability of the compound represented by the formula (I) is dramatically improved by using the compound together with the higher fatty acid or the metal salt of the higher fatty acid. The details of the reason why the excellent effects of the present invention described above can be obtained have not been elucidated. It is presumed that the higher fatty acid and the metal salt thereof serve to improve the dispersibility of a charge control agent the compound represented by the formula (I), though it has been known that aggregates of a charge control agent in a toner are easily detached from the toner and adhered to the surface of a carrier, thereby adversely affecting the triboelectric chargeability of the toner.

Further, the toner used in the present invention may appropriately contain an additive such as a colorant, a releasing agent, an electric conductivity modifier, an extender, a reinforcing filler such as a fibrous substance, an antioxidant, an anti-aging agent, a fluidity improver and a cleanability improver.

As the colorants, all of the dyes, pigments and the like which have been used as colorants for toners can be used, and the colorants include carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, car mine 6B, diazo yellow, and the like. These colorants can be used alone or in admixture of two or more kinds. The toner of the present invention can be used as any of black toners and color toners. Since all of the compounds represented by the formula (I), the higher fatty acid and the metal salt thereof do not adversely affect the color of a toner, the effects of the present invention can be more markedly exhibited especially in the case where the toner of the present invention is used as a color toner in which the use of a charge control agent tends to be limited. The content of the colorant is preferably from 1 to 40 parts by weight, more preferably from 3 to 10 parts by weight, based on 100 parts by weight of the resin binder.

The toner in the present invention may be a toner obtained by any of conventionally known methods such as a kneading-pulverization method, and a emulsion phase-inversion method and a polymerization method, and a pulverized toner prepared by the kneading-pulverizing method is preferable from the viewpoint of productivity. In the case of the pulverized toner prepared by the kneading-pulverizing method, the toner can be prepared by homogeneously mixing the raw materials such as a resin binder, a compound represented by the formula (I), a higher fatty acid or a metal salt thereof in a mixer such as a HENSCHEL MIXER thereafter melt-kneading the mixture with a closed kneader, a single-screw or twin-screw extruder, or the like, followed by cooling, pulverization, and classification. In the emulsion phase-inversion method, the toner can be prepared by dissolving or dispersing the raw materials in an organic solvent, thereafter adding water to emulsify the mixture, followed by separation and classification. The toner has a volume-average particle size of preferably from 3 to 15 μm. Further, an external additive such as a fluidity improver may be added to the surface of the toner.

The toner of the present invention can be used as a magnetic monocomponent developer, in a case where the magnetic material powder is contained. In a case where the magnetic material powder is not contained, the toner may be used alone as a nonmagnetic monocomponent developer, or the toner can be mixed with a carrier to be used as a two-component developer.

As the core material for the carrier, those made of a known material can be used without particular limitation. The core material includes, for instance, ferromagnetic metals such as iron, cobalt and nickel; alloys and compounds such as magnetite, hematite, ferrite, copper-zinc-magnesium-based ferrite and manganese-based ferrite; glass beads; and the like. Among them, iron powder, magnetite, ferrite, copper-zinc-magnesium-based ferrite and manganese-based ferrite are preferable.

The surface of the carrier may be coated with a resin. The resin to be coated on the surface of the carrier varies depending on the material for the toner. The resin includes, for instance, fluororesins such as polytetrafluoroethylenes, monochlorotrifluoroethylene polymers and poly(vinyldene fluoride); silicone resins such as dimethylsilicone; polyester resins, styrenic resins, acrylic resins; polyamides; polyvinyl butyrals, aminoacrylate resins and the like. These resins can be used alone or in admixture of two or more kinds. The fluororesins and the silicone resins are preferable from the viewpoints of the positive chargeability of the toner and the durability of the coating material.

The method for coating the core material with the resin is not particularly limited, and includes, for instance, a method comprising dissolving or suspending a coating material such as a resin in a solvent, applying the resulting solution or suspension to a carrier to adhere the resin thereto; a method comprising simply mixing a core material with a powder of a resin; and the like.

In the two-component developer obtained by mixing a toner and a carrier, the weight ratio of the toner to the carrier (toner/carrier) is preferably from 0.5/100 to 8/100, more preferably from 1/100 to 6/100.

EXAMPLES

[Acid Value]

The acid value is determined by a method according to JIS K 0070.

[Softening Point]

The softening point refers to a temperature at which a half of the resin flows out, when measured by using a flow tester of the "koka" type ("CFT-500D," commercially available from Shimadzu Corporation) (sample: 1 g, heating rate: 6° C./min, load: 1.96 MPa, and nozzle: 1 mm ϕ×1 mm).

[Glass Transition Point]

The glass transition point is determined using a differential scanning calorimeter ("DSC 210," commercially available from Seiko Instruments, Inc.) with raising the temperature at a rate of 10° C./min.

[Weight Percentage of Components Insoluble to Chloroform]

A 100 ml-glass bottle equipped with a screw cap is charged with 5 g of a resin powder, 5 g of "RADIOLITE #700" (commercially available from Showa Kagaku Kogyo K.K.) and 100 ml of chloroform, and the ingredients are stirred in a ball-mill at 25° C. for 5 hours. Thereafter, the resulting mixture is subjected to pressure filtration with a filter paper (No. 2 Paper, commercially available from Toyo Roshi Kaisha, Ltd.) which is evenly packed with 5 g of RADIOLITE. Subsequently, the solids on the filter paper are washed twice with 100 ml of chloroform, and then dried. Further, a weight percentage of components insoluble to chloroform is calculated according to the following equation:

$$\text{Weight Percentage of Insoluble Components (\% by weight)} = \frac{\text{Weight (g) of Solids on Filter Paper} - \text{Weight of } \textit{RADIOLITE} \text{ (10 g)}}{5\text{ g}} \times 100$$

Resin Preparation Examples (Resins A and B)

A 4-liter four-necked flask equipped with a thermometer, a stainless stirring rod, a reflux condenser, and a nitrogen inlet tube was charged with the raw material monomers for a condensation polymerization resin, as shown in Table 1, and the ingredients were reacted in a mantle heater under nitrogen atmosphere at a temperature of 220° C. with stirring. The polymerization degree was monitored by the softening point determined according to ASTM D36-86, and the reaction was terminated when a given softening point was reached. The reaction product was taken out from the flask, cooled, and thereafter pulverized, to give Resin A or B. The acid value, the softening point, the glass transition point and the weight percentage of component insoluble to chloroform of each of the resulting resins are shown in Table 1.

Resin Preparation Example (Resin C)

A 4-liter four-necked flask equipped with a thermometer, a stainless stirring rod, a reflux condenser, and a nitrogen inlet tube was charged with the raw material monomers for a condensation polymerization resin, as shown in Table 1, and the ingredients were reacted in a mantle heater under nitrogen atmosphere at a temperature of 135° C. with stirring, while a mixture previously prepared by mixing raw material monomers for a vinyl resin, as shown in Table 1, was added dropwise from a dropping funnel to the above ingredients over a period of 4 hours. The resulting mixture was aged for 5 hours, with maintaining the temperature at 135° C. Thereafter, the temperature was raised to 230° C., and the mixture was then reacted. The polymerization degree was monitored by the softening point determined according to ASTM D36-86, and the reaction was terminated when a given softening point was reached. The reaction product was taken out from the flask, cooled, and thereafter pulverized, to give Resin C. The acid value, the softening point, the glass transition point and the weight percentage of component insoluble to chloroform of the resulting resin are shown in Table 1.

TABLE 1

| | Resin A | Resin B | Resin C |
|---|---|---|---|
| Raw Material Monomers for Condensation Polymerization Resin | | | |
| BPA-PO[1)] | 1225 | 1225 | 1000 |
| BPA-EO[2)] | 488 | 488 | 200 |
| Terephthalic Acid | 400 | 500 | 300 |
| Dodecenylsuccinic Anhydride | 110 | 315 | 150 |
| Trimellitic Anhydride | 80 | 240 | 125 |
| Adipic Acid | — | — | 20 |
| Raw Material Monomers for Vinyl Resin | | | |
| Styrene | — | — | 350 |
| 2-Ethylhexyl Acrylate | — | — | 60 |
| Dicumyl Peroxide | — | — | 25 |

TABLE 1-continued

| | Resin A | Resin B | Resin C |
|---|---|---|---|
| Acid Value (mg KOH/g) | 6 | 18 | 25 |
| Softening Point (° C.) | 148 | 146 | 150 |
| Glass Transition Point (° C.) | 63 | 62 | 61 |
| Weight Percentage of Component Insoluble to Chloroform (% by weight) | 22 | 25 | 29 |

[1)]Propylene oxide adduct of bisphenol A (2.2 moles)
[2)]Ethylene oxide adduct of bisphenol A (2.2 moles)

Examples 1 to 4 and Comparative Examples 1 to 4

A resin binder, a charge control agent, a metal salt of higher fatty acid and a colorant, as shown in Table 2, and 2 parts by weight of a low-molecular weight polypropylene wax "550P" (commercially available from SANYO CHEMICAL INDUSTRIES, LTD.) were pre-mixed, and thereafter melt-kneaded with a twin-screw extruder, to give a kneaded product. The resulting kneaded product was then cooled, and subjected to a usual pulverization process and classification process, to give an untreated toner having a volume-average particle size of 10 μm. Incidentally, in the charge control agent as shown in Table 2, Compound A is "COPY CHARGE PSY" (commercially available from Clariant) comprising a compound represented by the formula (II):

(II)

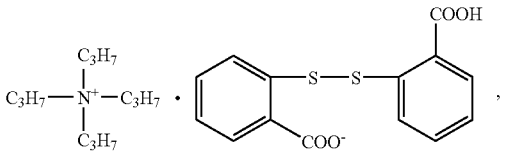

and Compound B is "TP-415" (commercially available from Hodogaya Chemical Co., Ltd.) comprising a compound represented by the formula (III):

(III)

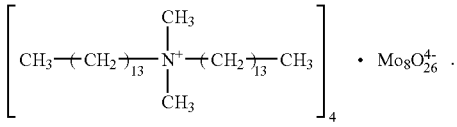

To 100 parts by weight of the resulting untreated toner were added 0.3 parts by weight of a hydrophobic silica "H-2000" (commercially available from Wacker Chemical). The ingredients were mixed with a Henschel mixer to adhere the silica to the untreated toner, and sieved, to give a toner.

Thirty-five parts by weight of the resulting toner and 965 parts by weight of a ferrite carrier coated with a silicone resin (average particle size: 110 μm) were mixed, to give a two-component developer.

TABLE 2

| | Resin Binder | Charge Control Agent | Metal Salt of Higher Fatty Acid | Colorant |
|---|---|---|---|---|
| Example 1 | Resin A/100 | Compound A/1 | Lithium Stearate/1 | Pigment Yellow 185/3 |
| Example 2 | Resin B/100 | Compound A/1.5 | Lithium Stearate/1.5 | Pigment Red 122/5 |
| Example 3 | Resin C/100 | Compound A/0.8 | Lithium Stearate/1 | Pigment Blue 16/3 |
| Example 4 | Resin C/100 | Compound A/0.8 Compound B/1 | Lithium Stearate/1 | Pigment Blue 16/3 |
| Comparative Example 1 | Resin A/100 | Compound A/1 | — | Pigment Yellow 185/3 |
| Comparative Example 2 | Resin A/100 | — | Lithium Stearate/1 | Pigment Yellow 185/3 |
| Comparative Example 3 | Resin A/100 | — | — | Pigment Yellow 185/3 |
| Comparative Example 4 | Resin C/100 | Compound B/1 | Lithium Stearate/1 | Pigment Blue 16/3 |

Note)
The amounts shown underneath each slash (/) are expressed as parts by weight.

Test Example 1

A 100000-sheet printing was carried out using a commercially available laser beam printer comprising a selenium photoconductor, with a printing ratio of 0.1 to 30%. The triboelectric charges and the image density in the durability printing, and the presence or absence of toner scattering generated by the durability printing were determined or evaluated according to the methods described below. The results are shown in Table 3.

[Triboelectric Charges]

The triboelectric charges are determined using a blowoff-type measuring apparatus.

[Image Density]

The image density is determined using a colorimeter "GRETAG SPM 50" (commercially available from GRETAG).

[Toner Scattering]

The extent of toner scattering in the surrounding of the developing device is visually evaluated after printing 100000 sheets.

TABLE 3

| | 10 sheets | 10000 sheets | 20000 sheets | 30000 sheets | 50000 sheets | 100000 sheets | Contamination in Inside of Machine due to Toner Scattering |
|---|---|---|---|---|---|---|---|
| Example 1 | | | | | | | |
| Triboelectric Charges (μC/g) | 18.5 | 19.2 | 20.3 | 19.8 | 19.2 | 19.5 | Almost None |
| Image Density | 1.32 | 1.38 | 1.35 | 1.31 | 1.30 | 1.28 | |
| Example 2 | | | | | | | |
| Triboelectric Charges (μC/g) | 17.5 | 19.1 | 18.3 | 17.2 | 16.8 | 17.5 | Almost None |
| Image Density | 1.35 | 1.37 | 1.38 | 1.39 | 1.41 | 1.39 | |
| Example 3 | | | | | | | |
| Triboelectric Charges (μC/g) | 16.8 | 17.6 | 18.2 | 18.1 | 17.6 | 17.2 | Almost None |
| Image Density | 1.38 | 1.34 | 1.32 | 1.33 | 1.34 | 1.36 | |
| Example 4 | | | | | | | |
| Triboelectric Charges (μC/g) | 17.6 | 18.6 | 19.1 | 20.0 | 19.2 | 18.8 | Almost None |
| Image Density | 1.34 | 1.32 | 1.30 | 1.32 | 1.34 | 1.35 | |
| Comparative Example 1 | | | | | | | |
| Triboelectric Charges (μC/g) | 17.3 | 15.8 | 14.3 | 13.2 | 12.0 | 10.5 | Generated in large amount |
| Image Density | 1.35 | 1.38 | 1.42 | 1.45 | 1.49 | 1.50 | |
| Comparative Example 2 | | | | | | | |
| Triboelectric Charges (μC/g) | 16.2 | 15.1 | 12.3 | 11.8 | 10.2 | 9.3 | Generated in large amount |
| Image Density | 1.38 | 1.41 | 1.40 | 1.42 | 1.48 | 1.52 | |
| Comparative Example 3 | | | | | | | |
| Triboelectric Charges (μC/g) | 10.5 | 11.0 | 10.3 | 9.5 | 8.0 | 7.2 | Generated in large amount |
| Image Density | 1.55 | 1.50 | 1.51 | 1.62 | 1.63 | 1.65 | |
| Comparative Example 4 | | | | | | | |
| Triboelectric Charges (μC/g) | 20.5 | 21.3 | 21.8 | 22.3 | 23.2 | 23.9 | Almost None |
| Image Density | 1.28 | 1.15 | 1.10 | 1.02 | 0.90 | 0.85 | |

It is clear from the above results that the triboelectric charges and the image density during the durability printing show little change and are stable in any of Examples. By contrast, it is clear from the above results that the triboelectric charges are lowered and toner scattering is generated during the durability printing in Comparative Example 1 in which the compound represented by the formula (I) is used but the metal salt of the higher fatty acid is not used, that Comparative Examples 1 and 2 in which either one of the compound represented by the formula (I) or the higher fatty acid is used, and that in Comparative Example 3 in which neither the compound represented by the formula (I) nor the higher fatty acid is used, the triboelectric charges are low from the initial period of the durability printing and toner scattering is generated. In addition, it is clear from the results of Comparative Example 4 that the triboelectric charges are increased and the image density is markedly lowered in the case of the combination of the compound represented by the formula (III) and the higher fatty acid.

The positively chargeable toner of the present invention is highly excellent in the triboelectric stability because the changes in the triboelectric charges due to a durability printing are small. Further, the positively chargeable toner of the present invention can be suitably used as a color toner because the charge control agent substantially does not affect the color of a toner.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A positively chargeable color toner comprising:

a resin binder composed of a polyester and/or a hybrid resin in which a polyester component and a vinyl resin component are partially chemically bonded to each other;

a compound represented by the formula (I):

(I)

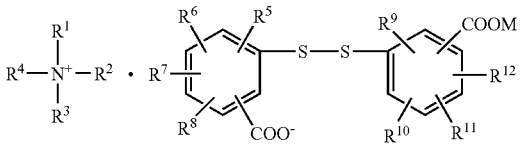

wherein each of $R^1$ to $R^4$, which may be identical or different, is hydrogen atom, an alkyl group having 1 to 30 carbon atoms, an alkenyl group having 2 to 30 carbon atoms, an aryl group having 6 to 20 carbon atoms or an aralkyl group having 7 to 20 carbon atoms; each of $R^5$ to $R^{12}$, which may be identical or different, is a hydrogen atom, an alkyl group having 1 to 30 carbon atoms or an alkenyl group having 2 to 30 carbon atoms; and M is a hydrogen atom or a monovalent metal ion;

lithium stearate; and at least one colorant selected from the group consisting of Pigment Yellow 185,Pigment Red 122, and Pigment Blue 16, wherein the compound represented by the formula (I) is contained in an amount of from 0.1 to 3 parts by weight based on 100 parts by weight of the resin binder, and wherein a total amount of the lithium stearate is from 0.5 to 3 parts by weight based on 100 parts by weight of the resin binder, and wherein the toner is prepared by a method comprising the steps of mixing raw materials comprising the resin binder, the compound represented by the formula (I), the lithium stearate, and the colorant, and melt-kneading the mixture.

2. The toner according to claim 1, a total amount of the polyester and/or the hybrid resin is from 50 to 100% by weight of the resin binder.

3. The toner according to claim 1, wherein the colorant is present at 1 to 40 parts by weight of the colorant based on 100 parts by weight of the resin binder.

4. The toner according to claim 1, wherein the toner has a volume-average particle size of from 3 to 15 μm.

5. The toner according to claim 1, wherein the resin binder polyester and/or hybrid resin has a softening temperature of 80° C. to 165° C.

6. The toner according to claim 1, wherein the resin binder polyester and/or hybrid resin has a glass transition temperature of 50° C. to 85° C.

7. The toner according to claim 1, wherein the resin binder polyester and/or hybrid resin has an acid value of from 0.5 to 60 mg KOH/g.

8. The toner according to claim 1, wherein the resin binder polyester and/or hybrid resin has a hydroxyl value of from 1 to 60 mg KOH/g.

9. A two-component developer, which comprises a color toner mixed with a carrier at a ratio of 0.5/100 to 8/100 of the toner to the carrier, wherein said color toner is a positively chargeable color toner comprising:

a resin binder composed of a polyester and/or a hybrid resin in which a polyester component and a vinyl resin component are partially chemically bonded to each other;

a compound represented by the formula (I):

(I)

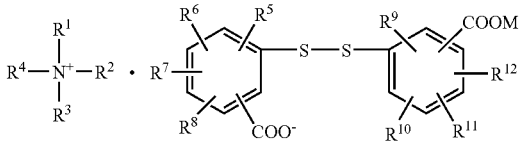

wherein each of $R^1$ to $R^4$, which may be identical or different, is hydrogen atom, an alkyl group having 1 to 30 carbon atoms, an alkenyl group having 2 to 30 carbon atoms, an aryl group having 6 to 20 carbon atoms or an aralkyl group having 7 to 20 carbon atoms; each of $R^5$ to $R^{12}$, which may be identical or different, is a hydrogen atom, an alkyl group having 1 to 30 carbon atoms or an alkenyl group having 2 to 30 carbon atoms; and M is a hydrogen atom or a monovalent metal ion;

lithium stearate; and at least one colorant selected from the group consisting of Pigment Yellow 185, Pigment Red 122, and Pigment Blue 16, wherein the compound represented by the formula (I) is contained in an amount of from 0.1 to 3 parts by weight based on 100 parts by weight of the resin binder, and wherein a total amount of the lithium stearate is from 0.5 to 3 parts by weight based on 100 parts by weight of the resin binder and wherein the toner is prepared by a method comprising the steps of mixing raw materials comprising the resin binder, the compound represented by the formula (I), the lithium stearate, and the colorant, and melt-kneading the mixture.

10. The two-component developer according to claim 9, wherein the toner is mixed with the carrier at a ratio of 1/100 to 6/100 of the toner to the carrier.

11. The two-component developer according to claim 9, wherein the carrier is a magnetic carrier including a ferromagnetic core.

12. The two-component developer according to claim 9, wherein the carrier includes a core containing a material selected from the group consisting of iron, cobalt, nickel, magnetite, hematite, ferrite, copper-zinc-magnesium-based ferrite, manganese-based ferrite and glass beads.

13. The two-component developer according to claim 9, wherein the carrier is coated with at least one resin selected from the group consisting of polytetrafluoroethylene fluororesin, monochlorotrifluoroethylene fluororesin, poly(vinylidene fluoride) fluororesin, dimethylsilicone resin, polyester resin, acrylic resin, polyamide resin, polyvinyl butyral resin and aminoacrylate resin.

* * * * *